United States Patent [19]

Veldman

[11] Patent Number: 4,952,845

[45] Date of Patent: Aug. 28, 1990

[54] DC/AC CONVERTER FOR IGNITING AND OPERATING A DISCHARGE LAMP

[75] Inventor: Paul R. Veldman, Oss, Netherlands

[73] Assignee: U.S. Philips Corporation, New York, N.Y.

[21] Appl. No.: 712,289

[22] Filed: Mar. 15, 1985

[30] Foreign Application Priority Data

Mar. 23, 1984 [NL] Netherlands ..... 8400924

[51] Int. Cl.[5] ..... H05B 41/29

[52] U.S. Cl. ..... 315/209 R; 315/226; 315/243; 315/DIG. 5; 315/DIG. 7

[58] Field of Search ..... 315/DIG. 7, DIG. 5, 315/273, 243, 245, 226

[56] References Cited

U.S. PATENT DOCUMENTS 3,740,609 6/1973 Moerkens ..... 315/273
4,370,600 1/1983 Zansky ..... 315/244
4,461,980 7/1984 Nilssen ..... 315/DIG. 7
4,588,924 5/1986 Luursema et al. ..... 315/DIG. 7

FOREIGN PATENT DOCUMENTS 989466 5/1976 Canada .

*Primary Examiner*—Eugene R. LaRoche

[57] ABSTRACT

A DC/AC converter (8) having a half bridge circuit for igniting and feeding a gas and/or vapour discharge tube (1). A starting capacitor (94) of this converter is connected between a junction (A) between two branches—each comprising a semiconductor circuit element (60 and 61)—of the half bridge circuit on the one hand and a center tapping (E) of a voltage divider (90, 91) on the other hand. As a result, the converter (8) starts satisfactorily and hence the discharge tube (1) readily ignites, moreover undesired starting pulses during the operating condition are avoided.

24 Claims, 1 Drawing Sheet

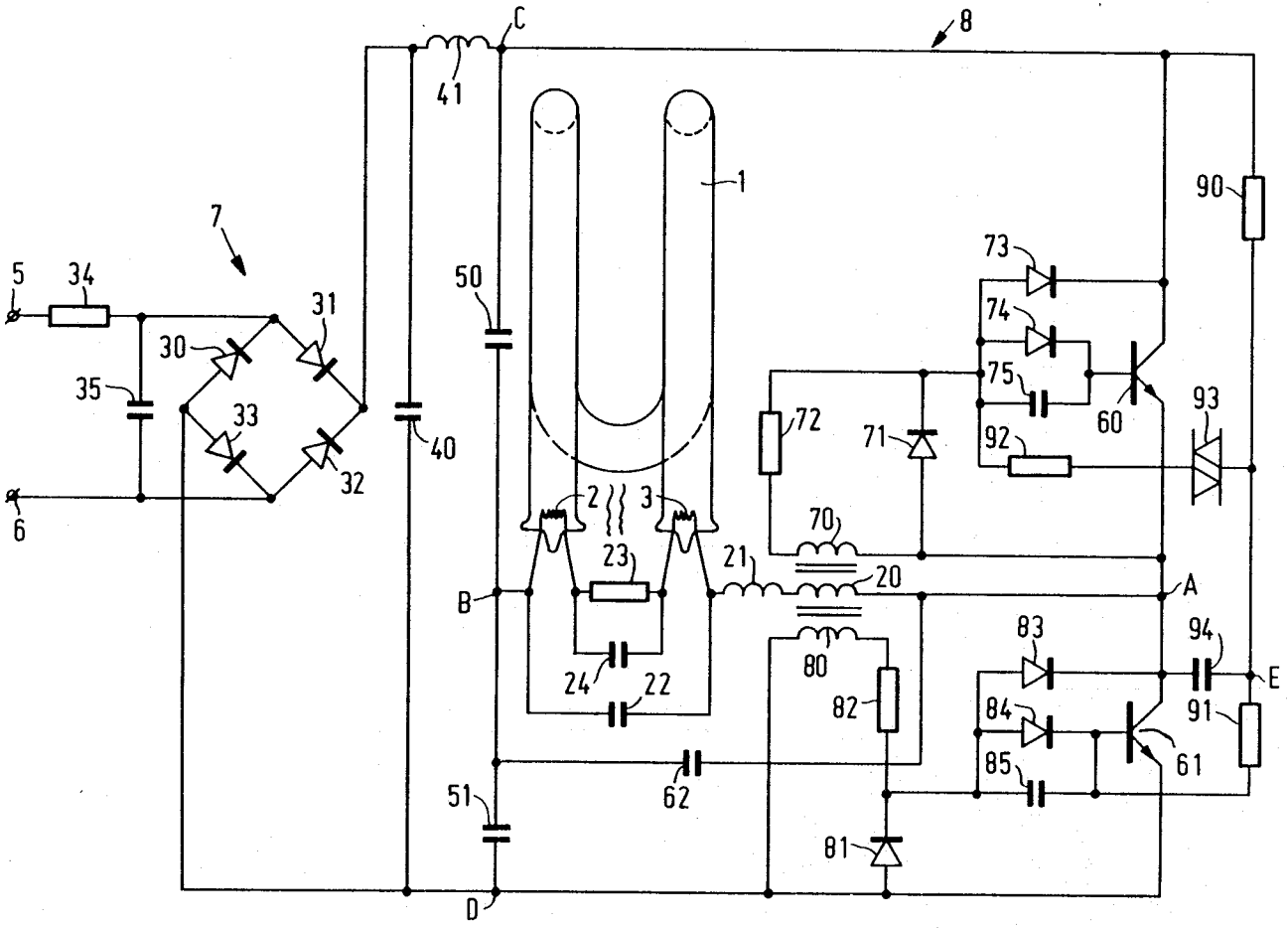
8
90
93
E
94
91
61
A
60
73
74
75
92
83
84
85
71
20
70
72
82
80
81
1
21
3
22
23
2
24
62
C
41
50
B
51
D
40
31
32
7
30
33
34
35
5
6

DC/AC CONVERTER FOR IGNITING AND OPERATING A DISCHARGE LAMP

BACKGROUND OF THE INVENTION

This invention relates to a DC/AC converter for igniting and feeding a gas and/or vapor discharge tube, the converter having two input terminals which are interconnected through a first series arrangement at least comprising a first controlled semiconductor switch element, a load circuit which—in the operating condition—is to include the discharge tube, and a first capacitor, the load circuit together with at least the first capacitor being shunted by a second controlled semiconductor switch element and provided with a circuit element for shunting the discharge tube, a second capacitor is connected parallel to at least the first controlled semiconductor switch element and in series with the first capacitor. The converter is provided with a starting circuit which is connected to a control electrode of one of the controlled semiconductor switch elements and which comprises a second series arrangement of a starting capacitor and a threshold element, and provision is further made of a charge circuit—comprising a resistor—of the starting circuit.

A known DC/AC converter of the kind mentioned is described, for example, in U.S. Pat. No. 4,525,648 (6/25/85). The starting of this converter takes place in that—after the two input terminals of the converter are connected to a direct voltage source—the starting capacitor will be charged to a voltage which is substantially equal to the threshold voltage of the threshold element. This threshold element then in fact breaks down and supplies a pulse to the control electrode of one of the controlled semiconductor switch elements. As a result, this switch element begins to conduct. A current will then flow through this switch element and the load circuit. Subsequently, this switch element becomes non-conducting and the other switch element becomes conducting. This process is then continuously repeated. This leads to an oscillation, i.e. an alternating current through the load circuit including the discharge tube.

A disadvantage of the known DC/AC converter is that, when repeatedly switching on at an output voltage of substantially constant effective value, the starting pulse at the control electrode of the relevant semiconductor circuit element invariably appears a fixed time interval after switching on of the voltage source. This means that this starting pulse may also appear at a premature instant, i.e. if the process of starting the converter cannot be followed by a further oscillation. This disadvantageous situation—which may be accompanied by flickering of the discharge tube—may arise, for example, if during the occurrence of the starting pulse the first capacitor—and/or the second capacitor—has received only a small electrical charge.

SUMMARY OF THE INVENTION

An object of the invention is to provide a DC/AC converter of the kind mentioned in the opening paragraph, in which the starting pulse appears only at an instant at which the process of starting the converter can be followed by a further oscillation.

A DC/AC converter according to the invention for igniting and feeding a gas and/or vapour discharge tube comprises a converter having two input terminals which are interconnected through a first series arrangement at least comprising a first controlled semiconductor switch element, a load circuit which—in the operating condition—is to include the discharge tube, and a first capacitor. The load circuit together with at least the first capacitor is shunted by a second controlled semiconductor switch element and is provided with a circuit element for shunting the discharge tube. A second capacitor is connected parallel to at least the first controlled semiconductor switch element and in series with the first capacitor. The converter is provided with a starting circuit which is connected to a control electrode of one of the controlled semiconductor switch elements and which includes a second series arrangement of a starting capacitor and a threshold element. Provision is further made of a charge circuit for the starting capacitor which includes a resistor of the starting circuit. The invention is characterized in that the charge circuit is connected to a junction between the two controlled semiconductor switch elements.

An advantage of this DC/AC converter is that the instant at which the starting pulse is supplied is determined by the electrical condition of the converter circuit. This means that the possibility of the occurrence of an oscillation following the starting pulse is comparatively large.

The following explanation is given. The charge circuit of the starting capacitor of the said known converter interconnects the input terminals of the converter. This means that a substantially constant voltage is applied to this charge circuit. The invention is based on the idea of connecting the charge circuit to a variable voltage, i.e. to a voltage which is a measure of the instantaneous electrical condition of the circuit. It has been found that this object can be achieved by connecting the charge circuit to a junction between the two controlled semiconductor switch elements.

After the converter is set into oscillation (operating condition), the starting capacitor can be switched off so that no further starting pulses are supplied to the relevant controlled semiconductor circuit element.

In a preferred embodiment of a DC/AC converter according to the invention, a part of the charge circuit comprising the resistor consists of a first part of a voltage divider, while a second part of the voltage divider comprises a second resistor. The starting capacitor is connected between the junction between the two controlled semiconductor switch elements on the one hand and a center tapping of the voltage divider located between the first and the second parts on the other hand, the voltage divider shunting a series arrangement of the main electrode circuit of one of the semiconductor switch elements and at least one electrode combination of the second semiconductor switch element connected thereto.

An advantage of this preferred embodiment is that in the operating condition of the converter the effective voltage across the starting capacitor can be comparatively small. The threshold voltage of the threshold element is consequently no longer reached. This means that undesired starting pulses—during the operating condition of the converter—are then avoided. In this preferred embodiment it is not necessary to switch off the starting capacitor by means of a separate switch.

In another preferred embodiment of a DC/AC converter according to the invention, the circuit element for shunting the discharge tube is a resistor having a positive temperature coefficient (PTC).

An advantage of this preferred embodiment is that through this resistor, which is generally low-ohmic immediately after switching on, the first capacitor and the second capacitor of the converter can be charged rapidly. As a result, the converter can be readily started so that the process of subsequently starting the discharge tube can then be rapidly initiated.

This preferred embodiment is of particular advantage for a discharge tube provided with preheatable electrodes. These electrodes can then be further preheated via the PTC resistor. When the electrodes are thus preheated, the life of the discharge tube is generally lengthened.

BRIEF DESCRIPTION OF THE DRAWING

An embodiment of the invention will now be described more fully with reference to the accompanying FIGURE. This FIGURE shows an electrical circuit of a DC/AC converter according to the invention and a gas and/or vapor discharge tube connected thereto. Furthermore, this Figure shows a rectifier device whereby input terminals of the DC/AC converter are connected to output terminals of the rectifier device.

DESCRIPTION OF THE PREFERRED EMBODIMENTS

In the Figure, reference numeral 1 denotes a lowpressure mercury vapor discharge tube of about 18 W. This discharge tube has the form of a hook. The discharge tube 1 is provided with two preheatable electrodes 2 and 3.

Reference numerals 5 and 6 designate input terminals intended to be connected to an electrical supply source of about 220 V, 50 Hz.

The discharge tube 1 is ignited and fed via an AC/DC converter 7 connected to the terminals 5 and 6 and a succeeding DC/AC converter 8 according to the invention. The converter 8 is of the half bridge type (50,51,60,61), the ends of an intermediate branch being denoted by A and B.

The construction of the converter 8 is as follows. Input terminals of this converter are denoted by C and D. The terminal C is connected via a first series arrangement of a first controlled semiconductor switch element 60, an intermediate branch A,B constructed as a load circuit including the discharge tube 1, and a first capacitor 51 to the terminal D. The intermediate branch is shunted together with at least the first capacitor 51 by a second controlled semiconductor switch element 61. Furthermore, the intermediate branch is provided with a circuit element shunting the discharge tube 1, i.e. a resistor 23 having a positive temperature coefficient (PTC). A second capacitor 50 is further connected both parallel to at least the first controlled semiconductor switch element 60 and in series with the first capacitor 51. The two controlled semiconductor switch elements 60 and 61 are npn-transistors.

The intermediate branch A,B of the converter 8 will now be described. Thereafter, the remaining parts of the circuit will be disclosed.

The terminal A is connected via a series arrangement of a primary winding 20 of a current transformer and an inductive stabilization ballast 21 to a first end of the preheatable electrode 3 of the discharge tube 1. The terminal B is connected to a first end of the preheatable electrode 2 of the discharge tube 1. The first ends of the two electrodes 2 and 3 are interconnected through a capacitor 22. The ends of the two electrodes 2 and 3 remote from the supply source are interconnected through a parallel arrangement of the resistor 23 having a positive temperature coefficient (PTC) and a capacitor 24.

The AC/DC converter 7 is provided with a bridge comprising four diodes 30 to 33.

The input terminal 5 is connected via a resistor 34 to a first input terminal of the diode bridge. The terminal 6 is connected to a second input terminal of the diode bridge. The two input terminals of the diode bridge are interconnected through a capacitor 35. The combination of the resistor 34 and the capacitor 35 forms an input filter.

Two output terminals of the diode bridge are interconnected through a smoothing capacitor 40. A smoothing coil 41 is connected to this capacitor.

The DC/AC converter 8 is connected to the ends (C,D) of the combination of the capacitor 40 and the coil 47.

The junction A between the two transistors 60 and 61 and the junction B between the two capacitors 50 and 51 are interconnected through a capacitor 62 in parallel with the intermediate branch consisting of winding 20 in series with ballast inductor 21 and the parallel combination of the tube 1, the PTC resistor 23 and capacitors 24 and 22.

The part of the circuit still to be described relates to a control circuit for the transistors 60 and 61 of the DC/AC converter 8 and a starting circuit for this converter.

The control circuit of the transistor 60 is fed via a secondary winding 70 of the current transformer. A series arrangement of a diode 71 and a resistor 72 is connected to this winding 70. A junction between the winding 70 and the diode 71 is connected to the junction A. A junction between the diode 71 and the resistor 72 is connected via a diode 73 to the collector of the transistor 60. Furthermore, the junction between the diode 71 and the resistor 72 is connected via a parallel arrangement of a diode 74 and a capacitor 75 to the base of the transistor 60.

A series arrangement of a diode 81 and a resistor 82 is connected to a further second secondary winding 80 of the current transformer. The anode side of the diode 81 is also connected to the smoothing capacitor 40.

In a similar manner to the control circuit of the transistor 60, the control circuit of the transistor 61 connects a junction between the diode 81 and the resistor 82 via a diode 83 to the collector of the transistor 61. Furthermore, the junction between the diode 81 and the resistor 82 is connected via a parallel arrangement of a diode 84 and a capacitor 85 to the base of the transistor 61.

Moreover, a starting circuit of the converter 8 comprises a voltage divider provided with two resistors 90 and 91, and also a resistor 92, a bidirectional threshold element (Diac) 93 and a starting capacitor 94. This starting circuit is connected through the resistor 92 and via, inter alia, the diode 74 to the base of the transistor 60. The capacitor 94 is connected in series with a threshold element 93. This capacitor is connected between the junction A, between the two transistors 60 and 61, and a center tapping E of the voltage divider 90,91. The voltage divider 90,91 shunts the main electrode circuit (collector-emitter circuit) of the transistor 60 together with the collectorbase electrode junction of the transistor 61 connected thereto. A charge circuit for the capacitor 94 comprises the resistor 90 of the voltage divider and is connected, inter alia, to the junction (A) between the two transistors 60 and 61.

The circuit arrangement described operates as follows. If the terminals 5 and 6 are connected to the supply source of about 220 V, 50 Hz, the capacitor 40 will be charged via the diode bridge 30 to 33 inclusive. This ensures that—via the coil 41—the capacitors 50 and 51 will also be charged. Furthermore, the starting capacitor 94 will be charged; i.e. via the circuit 41,90,94 and inter alia A,B. If the voltage at the starting capacitor 94 then reaches the threshold voltage of the circuit element 93, the circuit element 93 will begins to conduct thereby rendering the transistor 60 conductive via the circuit elements 92 and 75/74.

This ensures that a current will flow via the capacitor 50, the transistor 60, the junction A, the circuit elements 20,21,3,23,2 to junction B. This current preheats the electrodes 2 and 3 of the discharge tube 1. The PTC resistor 23 is then in fact still comparatively cold, that is to say it is in its low-ohmic range.

Through the current transformer 20,70,80, the transistor 60 is rendered non-conducting and the transistor 61 is rendered conducting—via the control circuits of the two transistors—by the said current between terminals A and B. This results in a reversal of the direction of the current in the circuit A-B. This other current direction ensures—via the current transformer—that the transistor 61 becomes non-conducting and the transistor 60 becomes conducting. This process is continuously repeated. The alternating voltage then flowing in the circuit A-B provides a further preheating of the lamp electrodes 2 and 3. Of course, the PTC resistor 23 itself will also assume a higher temperature due to the current flowing through it. The heat capacity of this PTC resistor is chosen so that it reaches its change-over point between the low-ohmic range and the high-ohmic range at an instant at which the two electrodes 2 and 3 have reached their emission temperature. In the high-ohmic condition of the PTC resistor 23, the overall capacitance of the capacitors 22 and 24 is sufficient to produce—via a series resonance condition with the coil 21—a voltage between the electrodes 2 and 3 which is sufficient to cause the discharge tube 1 to ignite.

Since the PTC resistor 23 is arranged close to the discharge tube 1, the PTC resistor is kept, during operation of this discharge tube, at such a high temperature that the high-ohmic condition is maintained.

During the operating condition of the converter 8, the effective voltage across the starting capacitor 94 is substantially zero. This is due to the fact that both the potential of the junction A and the potential of the junction E are then on an average equal to half the potential of the junction C. This means that A and E substantially have the same potential. As such the voltage at the starting capacitor 94 can no longer reach the threshold voltage of the threshold element 93. This means that the starting circuit then does not generate any undesired starting pulses.

In an embodiment, the circuit elements had approximately the following values:

Capacitor 22: 2.2 nF
capacitor 24: 1.8 nF
capacitor 35: 33 nF
capacitor 40: 11 μF
capacitor 50: 220 nF
capacitor 51: 220 nF
capacitor 62: 910 pF
capacitor 75: 270 nF
capacitor 85: 270 nF
capacitor 94: 22 nF
coil 21: 3 mH
coil 41: 1.5 mH
transmission ratio of the transformer (winding 20,70,80)=1:1:1.
resistor 34: 4.7 Ω
resistor 72: 39 Ω
resistor 82: 39 Ω
resistor 90: 680 k Ω
resistor 91: 680 k Ω
resistor 92: 47 Ω

The threshold voltage of the circuit element 93 is approximately 32 V.

The converter 8 above starts in a reliable manner. The transistor 60 is not rendered conductive prematurely by the starting circuit 90 to 94 inclusive. The starting pulse therefore leads to an oscillation by means of which the transistors 60 and 61 become alternately conducting. After the converter has been started, the discharge tube 1 is caused to ignite, i.e. within one second after being switched on. The system efficiency of the circuit arrangement described is about 60 lumen/W.

What is claimed is:

1. A DC/AC converter for igniting and feeding a discharge tube comprising: two input terminals coupled to a first series arrangement comprising a first controlled semiconductor switch element, a load circuit which—in the operating condition—will include the discharge tube, and a first capacitor, the load circuit and at least the first capacitor being shunted by a second controlled semiconductor switch element, the load circuit including a circuit element for shunting the discharge tube, a second capacitor connected parallel to at least the first controlled semiconductor switch element and in series with the first capacitor, a starting circuit connected to a control electrode of one of the controlled semiconductor switch elements and which includes a second series arrangement of a starting capacitor and a threshold element, a charge circuit for the starting capacitor, including a resistor of the starting circuit, and means electrically connecting the charge circuit to a junction between the two controlled semiconductor switch elements.

2. A DC/AC converter as claimed in claim 1, characterized in that the resistor of the charge circuit comprises a first part of a voltage divider, a second part of the voltage divider including a second resistor, the starting capacitor being connected between the junction between the two controlled semiconductor switch elements and a centre tapping of the voltage divider, the voltage divider shunting a series arrangement of a main electrode circuit of one of the semiconductor switch elements and a control electrode—main electrode junction of the other semiconductor switch element connected thereto.

3. A DC/AC converter as claimed in claim 1, wherein the circuit element for shunting the discharge tube comprises a resistor having a positive temperature coefficient.

4. A DC/AC converter as claimed in claim 2, wherein the circuit element for shunting the discharge tube comprises a resistor having a positive temperature coefficient.

5. A DC/AC converter for igniting and operating a discharge lamp comprising: a pair of input terminals for connection to a source of DC supply voltage, first and second transistor switches connected in a first series circuit across the input terminals, first and second capacitors connected in a second series circuit across the input terminals, a load circuit having first and second terminals connected to first and second junction points, respectively, between the first and second transistor switches and between the first and second capacitors, respectively, said load circuit having a further pair of terminals for connection to the electrodes of a discharge lamp and a circuit element coupled to said further pair of terminals so as to shunt the discharge path of a discharge lamp when connected thereto, a starting circuit including a series arrangement of a starting capacitor and a voltage-threshold element connected between a control electrode of one of the transistor switches and said first junction point between the first and second transistor switches, and a resistor coupled to the starting capacitor and to one input terminal of the DC supply voltage so as to form a charge circuit for the starting capacitor.

6. A DC/AC converter as claimed in claim 5 wherein the load circuit further comprises a ballast impedance connected in series with the circuit element and a third capacitor coupled across the circuit element and in series with the ballast impedance.

7. A DC/AC converter as claimed in claim 6 further comprising a fourth capacitor connected between the first and second terminals of the load circuit.

8. A DC/AC converter as claimed in claim 5 wherein said resistor is connected in series with a second resistor to form a voltage divider coupled in shunt with a series arrangement of one of the transistor switches and a main electrode—control electrode junction of the other one of the transistor switches.

9. A DC/AC converter as claimed in claim 8 wherein said circuit element comprises a PTC resistor.

10. A DC/AC converter as claimed in claim 6 wherein said circuit element comprises a PTC resistor.

11. A DC/AC converter as claimed in claim 5 further comprising a transformer having a primary winding connected in series with a ballast impedance and said circuit element in the load circuit and first and second secondary windings coupled via first and second diodes, respectively, to control electrodes of the first and second transistor switches, respectively.

12. A DC/AC converter as claimed in claim 11 further comprising third and fourth capacitors coupled in parallel with the first and second diodes, respectively.

13. A DC/AC converter as claimed in claim 5 for operation of a discharge lamp with first and second preheatable electrodes wherein said circuit element comprises a PTC resistor connected in series with the first and second preheatable lamp electrodes when a lamp is connected to said further pair of terminals, said PTC resistor providing a low resistance preheat current path for the lamp electrodes upon the application of power to said pair of input terminals.

14. A DC/AC converter as claimed in claim 13 wherein said load circuit further comprises a ballast inductor connected in series with the PTC resistor, a third capacitor connected in parallel with the PTC resistor and a fourth capacitor coupled across outer ends of the first and second preheatable electrodes of a connected discharge lamp, said third and fourth capacitors and said series connected ballast inductor forming a resonant circuit for developing an ignition voltage sufficient to ignite a connected discharge lamp.

15. A DC/AC converter as claimed in claim 13 wherein the heat capacity of the PTC resistor is chosen so that the PTC resistor switches over from a low-ohmic state to a high-ohmic state in approximately the time it takes for the preheatable electrodes of a connected lamp to reach their normal emission temperature.

16. A DC/AC converter as claimed in claim 13 wherein the PTC resistor is located in thermal coupling relationship with a connected lamp so that, during operation of the lamp, the PTC resistor is maintained in its high-ohmic state.

17. A DC/AC converter as claimed in claim 13 wherein said resistor is connected in series with a second resistor to form a voltage divider coupled to at least one of said pair of input terminals and said starting capacitor is connected between said first junction point of the first and second transistors and a tap point on said voltage divider such that, in the operating condition of the converter, the voltage developed across the starting capacitor is insufficient to trigger the voltage threshold element.

18. A DC/AC converter as claimed in claim 5 wherein said circuit element comprises a PTC resistor whose heat capacity is chosen so that the PTC resistor switches over from a low-ohmic state to a high-ohmic state at a time related to a desired ignition point for a connected discharge lamp.

19. A DC/AC converter as claimed in claim 5 wherein said resistor is connected in series with a second resistor to form a voltage divider coupled to at least one of said pair of input terminals and said starting capacitor is connected between said first junction point of the first and second transistor switches and a tap point on said voltage divider such that, in the operating condition of the converter, the voltage developed across the starting capacitor is insufficient to trigger the voltage threshold element.

20. A DC/AC converter as claimed in claim 10 wherein the PTC resistor is located in thermal coupling relationship with a connected lamp so that, during operation of the lamp, the PTC resistor is maintained in its high-ohmic state.

21. A DC/AC converter as claimed in claim 5 including control circuit means coupled to control electrodes of the first and second transistor switches so as to drive the transistor switches alternately into conduction.

22. A DC/AC converter circuit for a discharge lamp comprising: a pair of input terminals for connection to a source of DC supply voltage, first and second transistor switches connected in a first series circuit across the input terminals, first and second capacitors connected in a second series circuit across the input terminals, a load circuit having first and second terminals connected to first and second junction points, respectively, between the first and second transistor switches and between the first and second capacitors, respectively, said load circuit having a further pair of terminals for connection to the electrodes of a discharge lamp and a circuit element coupled to said further pair of terminals, a starting circit for the converter circuit comprising a series arrangement of a resistor and a starting capacitor coupled between input terminal and a circuit point of the converter circuit, and a voltage threshold element coupling the starting capacitor to a control electrode of one of said transistor switches.

23. A DC/AC converter circuit as claimed in claim 22 wherein said circuit point is the first junction point, said starting capacitor being connected between said first junction point and a further circuit point such that, in the operating condition of a discharge lamp, a maximum voltage is developed across the capacitor which is less than the breakdown voltage of the voltage threshold element.

24. A DC/AC converter as claimed in claim 1, wherein said electrically connecting means includes the starting capacitor.

* * * * *